US005777555A

United States Patent [19]

Åsbrink

[11] Patent Number: 5,777,555

[45] Date of Patent: Jul. 7, 1998

[54] USING UNITARY TRANSMITTING/ RECEIVING ANTENNA

[76] Inventor: Leif Åsbrink, Jäders Prästgård, Pl 3265, S-635 00 Eskilstuna, Sweden

[21] Appl. No.: 817,957

[22] PCT Filed: Oct. 13, 1995

[86] PCT No.: PCT/SE95/01189

§ 371 Date: Apr. 9, 1997

§ 102(e) Date: Apr. 9, 1997

[87] PCT Pub. No.: WO96/12263

PCT Pub. Date: Apr. 25, 1996

[30] Foreign Application Priority Data

Oct. 13, 1994 [SE] Sweden ..... 9403495

[51] Int. Cl.[6] ..... G08B 13/187

[52] U.S. Cl. ..... 340/577; 340/551

[58] Field of Search ..... 340/572, 551

[56] References Cited

U.S. PATENT DOCUMENTS 4,212,002 7/1980 Williamson ..... 340/572

5,353,011 10/1994 Wheeler et al. ..... 340/572

FOREIGN PATENT DOCUMENTS 0153286 8/1985 European Pat. Off. .

WO9311516 6/1993 WIPO .

*Primary Examiner*—Glen Swann

*Attorney, Agent, or Firm*—Alfred J. Mangels

[57] ABSTRACT

An electronic alarm system of the kind used in commodity surveillance systems includes an alarm element which is adapted to receive a magnetic alternating field transmitted from a transmitter by means of a transmitter coil and also adapted to re-transmit a magnetic alternating field, wherein a receiver which includes a receiver coil is adapted to receive and detect the re-transmitted alternating field. The transmitter coil and the receiver coil are one and the same coil (1). Between the transmitter (TX) and the receiver (RX) on the one side and the transmitter-receiver coil (1) on the other side, there is provided an electronic unit (14) which includes a transformer (5) and a resistance (2) which are so adapted that when transmitting, a first part of the transmitter power will be applied to the transmitter coil (1) and the remaining part, a second part, will be applied to the resistance (2). When receiving a first part of the received signal will be applied to the receiver (RX) and the remaining part, the second part, will be applied to a circuit or to a resistance. Only a small part of the transmitter power will reach the receiver.

3 Claims, 1 Drawing Sheet

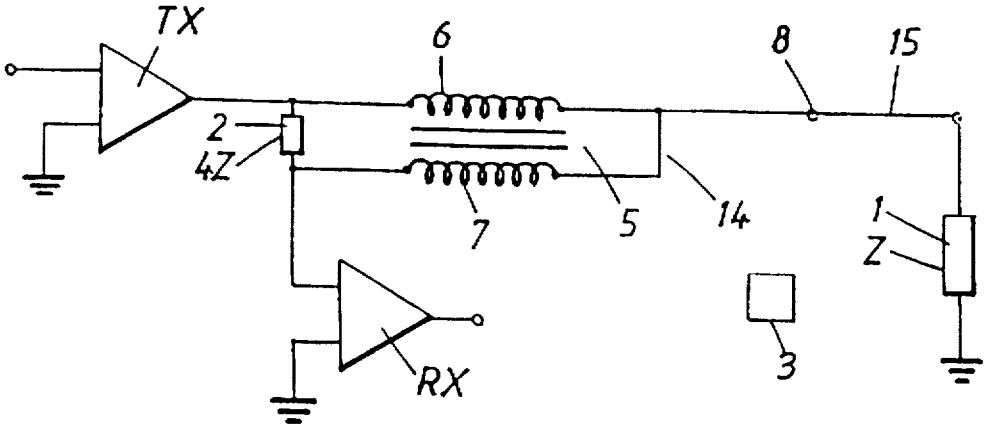
TX
6
8
15
2
4Z
7
5
14
1
Z
3
RX

USING UNITARY TRANSMITTING/ RECEIVING ANTENNA

BACKGROUND OF THE INVENTION

1. Field of the Invention

The present invention relates to an electronic alarm system of the kind used in commodity surveillance systems.

2. Description of the Related Art

Many different types of commodity surveillance alarm systems are described in the patent literature. These alarm systems are intended to prevent commodities from being removed from stores and the like without being paid for. The commodity surveillance alarm systems normally include some type of alarm element that is attached to the commodities to be protected, and a detection arrangement which is installed permanently at a store exit and which with the aid of some form of remote sensing device is able to produce an alarm when an alarm element is brought into the vicinity of the store exit.

This remote sensing of a commodity is normally effected by transmitting a magnetic alternating field, wherein the presence of an alarm element can be detected as a result of a change in the alternating field that is characteristic to the alarm element concerned.

Alarm elements may have the form of long, narrow thin strips of highly permeable material capable of transmitting high order harmonics when exposed to a magnetic alternating field. Using this basic principle, it is possible to detect the presence of small and inexpensive alarm elements with the aid of complicated and relatively expensive detector arrangements. This type of commodity surveillance alarm system is particularly well-suited for use in stores that sell everyday commodities, utilities or convenience goods and is described, inter alia, in European Patent Specification EP 0 153 286.

Also known to the art are alarm elements which consist of a simple electric resonance circuit. In this case, the detector arrangement can be made simple and inexpensive if the coil in the resonance circuit is made relatively large, wherewith a good Q-value can be readily obtained at the same time as coupling to external fields becomes large. In this case, the coil is placed in an alarm plate which is secured to the commodity to be protected with the aid of some kind of fastener means. As before mentioned, the detector arrangements for this type of alarm may be made relatively uncomplicated and inexpensive. However, it is difficult to avoid a false alarm, because the store environment will often include loops of conductive material which give rise to resonances similar to the resonances obtained with the alarm elements.

The detector arrangement of such alarm systems will often include two mutually spaced alarm arches which delimit the investigation zone. The alarm arches will normally include separate transmitter and receiver coils.

There is a strong desire to construct alarm systems that are both simpler and less expensive than existing systems. It is also desirable to lower the cost of installing an alarm system, among other things by simplifying the manner in which cables are drawn between the alarm arches and the electronic unit of the alarm system.

The present invention fulfils these desiderata and enables one and the same coil to be used both as a transmitter coil and as a receiver coil, and requires only one coaxial cable to be drawn up to respective alarm arches.

SUMMARY OF THE INVENTION

The present invention thus relates to an electronic alarm system of the kind used in a commodity surveillance system.

The system includes an alarm element which functions to receive a magnetic alternating field transmitted from a transmitter by means of a transmitter coil and which also functions to re-transmit a magnetic alternating field. A receiver includes a receiver coil and is adapted to receive and detect the re-transmitted alternating field. The system is characterized in that the transmitter coil and the receiver coil consists of one and the same coil, wherein a transformer and a resistance between the transmitter and the receiver on one side and the transmitter-receiver coil on the other side are so arranged that when transmitting a first part of the transmitter power is applied to the transmitter coil and the remaining part, a second part, of said transmitter power is applied to said resistance. When receiving, a first part of the received signal is applied to the receiver and the remaining part, the second part, of said signal is applied to a circuit or to said resistance.

BRIEF DESCRIPTION OF THE DRAWINGS

The invention will now be described in more detail with reference to an exemplifying embodiment thereof and also with reference to the accompanying drawing, in which The sole FIGURE illustrates an embodiment of the invention.

DESCRIPTION OF THE PREFERRED EMBODIMENTS

The sole FIGURE illustrates an embodiment of a transmitting and receiving arrangement for use in an electronic alarm system of the kind used in a commodity surveillance system. Such a system includes an alarm element 3 which is adapted to receive a magnetic alternating field which is transmitted from a transmitter TX by means of a transmitter coil and which is also adapted to re-transmit a magnetic alternating field, wherein a receiver RX connected to a receiver coil is adapted to receive and detect the re-transmitted alternating field. The transmitted alternating field has a frequency below 30 MHz, preferably a frequency of 8.2 MHz.

According to the invention, the transmitter coil and the receiver coil are one and the same coil, there being provided between the transmitter TX and the receiver RX on the one hand and the transmitter-receiver coil 1 on the other hand an electronic unit which includes a transformer 5 and a resistance 2 so arranged that when transmitting, a first part of the transmitter power will be applied to the transmitter coil 1 and the remaining part, a second part, will be applied to the resistance 2, and that when receiving, a first part of the received signal will be applied to the receiver RX and the remaining part, second part, will be applied to a circuit or to a resistance. This function whereby only a small part of the transmitter power reaches the receiver is dependent on the impedance that the electronic unit experiences or encounters towards the transmitter-and-receiver coil being the correct impedance, i.e. has the value for which the transformer and resistance are intended.

The transmitter-and-receiver coil may be connected in parallel to a capacitor and a resistor, such as to form a resonance circuit that has a low Q-value. In this way, the impedance is essentially constant, i.e. equal to the resistive value of the resistor over a sufficiently wide frequency range for the application in question, for instance a frequency of 8.2±0.5 MHz.

By arranging for the impedance of the transmitter-and-receiver coil to be equal to the characteristic impedance of the cable which extends between the electronic unit and the transmitter-and-receiver coil, for instance by transforming, the impedance at the electronic unit terminal to which the coil is connected will be independent of the length of the cable.

In a commodity surveillance system of this kind, the transmitted power is low, for instance in the order of one or a few watts.

The present invention is based on the realization that even if half the transmitter power is lost in heat in the resistance 2, all that is needed is to increase the transmitter power, for instance to double the transmitter power, with no actual cost. The saving afforded by and the simplicity of a common transmitter-and-receiver coil is obvious.

However, the present invention is also based on the realization that the sensitivity of the receiver is limited by external interference and disturbances from other electrical apparatus in the area in which the alarm system is used, and not by the signal/noise ratio of the alarm system itself. The function of the system will not be influenced to any appreciable extent by lowering the energy content of the received signal to, e.g., 50% of its typical energy content.

When the impedance of the transmitter-and-receiver coil is adapted to the cable that extends between the electronic unit and said coil, the length of the cable has no significance, or only negligible significance. The cable may be, for instance, a 50 ohm coaxial cable. This means that the transmitter and receiver equipment, including the electronic unit and the transmitter-and-receiver coil, can be made the same for all installations, or at least for a large number of installations, where the length of said cable is then adapted to the store area concerned. Both the manufacturing cost and the installation cost will therewith be relatively low.

The present invention thus fulfils the desiderata mentioned in the introduction.

FIG. 1 illustrates one embodiment of the invention. This embodiment includes a transformer 5 having a ferrite core and a ratio of 1:1. The two windings 6, 7 of the transformer are connected together on one side of the transformer to form a terminal 8 to which the transmitter-receiver coil 1 is connected by means of a coaxial cable 15. On the other side of the transformer, one of the transformer windings, winding 6 in this case, is connected to the transmitter TX and the other winding 7 is connected to the receiver RX. A resistance 2 is connected between the windings on said other side of the transformer. Provided that the resistance 2 has an impedance which is four times higher than the impedance which the electronic unit on the left of the terminal 8, in FIG. 1, experiences or encounters in the terminal 8, half of the transmitter power will be lost and also half of the received power.

When the characteristic impedance of the cable 15 is equal to the impedance Z of the load the transmitter receiver coil 1, the impedance at terminal 8 will be independent of cable length.

Furthermore, the electronic unit can be designed so that more than 50% of the transmitter power will be lost and thereby enable more than 50% of receiver power to be utilized, or vice versa.

The present invention is therefore not restricted to the aforedescribed embodiments thereof, since variations and modifications can be made within the scope of the following Claims.

What is claimed is:

1. An electronic alarm system for commodity surveillance systems that include an alarm element adapted to be associated with a commodity and to receive a magnetic alternating field transmitted from a transmitter by a transmitter coil and which alarm element is adapted to retransmit a magnetic alternating field that is detected and received by a receiver which includes a receiver coil, said system comprising: an alarm element for retransmitting a received alternating magnetic field; transmitter means for transmitting an alternating magnetic field, the transmitter means including a transmitter coil; receiver means for receiving an alternating magnetic field transmitted by the alarm element when the alarm element is within the alternating magnetic field transmitted by the transmitter means, the receiver means including a receiver coil; wherein the transmitter coil and the receiver coil are defined by a unitary transmitter/receiver coil; an electronic unit having a first terminal coupled with the transmitter means and the receiver means and having a second terminal coupled with the transmitter/receiver coil, the electronic unit including a transformer and a resistance, wherein during transmission of a magnetic alternating field by the transmitter means a first part of the transmitter means output is applied to the transmitter/receiver coil and a second part of the transmitter means output is applied to said resistance, and when the receiver means receives a magnetic alternating field from the alarm element, a first part of the received magnetic field signal is applied to the receiver means and a second part of the received magnetic field signal is applied to a load.

2. A system according to claim 1, wherein the transmitter/receiver coil has an impedance substantially equal to the impedance of a coaxial cable that extends between the electronic unit and the transmitter/receiver coil such that the system will operate effectively independent of the length of the cable.

3. A system according to claim 1, wherein the transformer includes two transformer windings that are connected together on one side of the transformer to form a terminal to which the transmitter-receiver coil is connected; and wherein on another side of the transformer one of the transformer windings is connected to the transmitter means and the other winding is connected to the receiver means; and wherein said resistance is connected between the windings on said other side of the transformer.

* * * * *

UNITED STATES PATENT AND TRADEMARK OFFICE

CERTIFICATE OF CORRECTION

PATENT NO. : 5,777,555
DATED : July 7, 1998
INVENTOR(S) : Leif Asbrink

It is certified that error appears in the above-identified patent and that said Letters Patent is hereby corrected as shown below:

On the title page, item [54]

Column 1, lines 1 and 2, correct the title to read: ELECTRONIC ALARM SYSTEM USING UNITARY TRANSMITTING/RECEIVING ANTENNA Signed and Sealed this Fifteenth Day of September, 1998

*Attest:*

*Attesting Officer*

Bruce Lehman

BRUCE LEHMAN

*Commissioner of Patents and Trademarks*